US012221314B2

(12) United States Patent
Chen

(10) Patent No.: US 12,221,314 B2
(45) Date of Patent: Feb. 11, 2025

(54) CARDBOARD CONVEYOR DEVICE, CARDBOARD CONVEYING METHOD AND PLATE BODY STRUCTURE

(71) Applicant: SUNRISE PACIFIC CO., LTD., Taoyuan (TW)

(72) Inventor: Chih-Wang Chen, Taoyuan (TW)

(73) Assignee: SUNRISE PACIFIC CO., LTD, Taoyuan (TW)

( * ) Notice: Subject to any disclaimer, the term of this patent is extended or adjusted under 35 U.S.C. 154(b) by 246 days.

(21) Appl. No.: 17/969,273

(22) Filed: Oct. 19, 2022

(65) Prior Publication Data

US 2024/0059515 A1 Feb. 22, 2024

(30) Foreign Application Priority Data

Aug. 17, 2022 (TW) ..... 111130986

(51) Int. Cl.
*B65H 5/22* (2006.01)

(52) U.S. Cl.
CPC ..... *B65H 5/224* (2013.01); *B65H 2406/322* (2013.01); *B65H 2406/36* (2013.01);
(Continued)

(58) Field of Classification Search
CPC ..... B65H 2406/322; B65H 2406/3221; B65H 2406/3222; B65H 2406/3223; B65H 5/224; B65H 2701/176
(Continued)

(56) References Cited

U.S. PATENT DOCUMENTS 3,477,558 A * 11/1969 Fleischauer ..... B65G 49/065 198/689.1
6,481,565 B1 * 11/2002 Sherwood ..... B65G 21/2036 198/689.1
(Continued)

FOREIGN PATENT DOCUMENTS

CN 211567102 A 9/2020
CN 213353703 A 6/2021
(Continued)

OTHER PUBLICATIONS

Notice of Allowance with the search report for the corresponding JP Appln. 2022-141278 issued Nov. 28, 2023.
(Continued)

*Primary Examiner* — Mark A Deuble
(74) *Attorney, Agent, or Firm* — Demian K. Jackson; Jackson IPG PLLC

(57) ABSTRACT

A cardboard conveyor device forms sub negative pressure regions communicative to a main negative pressure region by using wind shield structures of a plate body structure, thus saving power consumption of an aspirator. The plate body structure is for example formed by three plate bodies, the plate body of a middle layer has air holes, the plate body of an upper layer has first interval spaces penetrating the plate body of the upper layer, and the plate body of a lower layer has second interval spaces penetrating the plate body of the lower layer. Each of the first interval spaces is communicative to the corresponding second interval space via the corresponding air holes, and the second interval spaces are communicative to the main negative pressure region. Thus, the sub negative pressure regions can provide a negative pressure to the cardboard being conveyed.

12 Claims, 10 Drawing Sheets

(52) U.S. Cl.
CPC .... *B65H 2406/362* (2013.01); *B65H 2406/41* (2013.01); *B65H 2701/176* (2013.01); *B65H 2801/21* (2013.01)

(58) Field of Classification Search
USPC ..... 198/689.1
See application file for complete search history.

(56) References Cited

U.S. PATENT DOCUMENTS

| | | | | |
|---|---|---|---|---|
| 8,070,156 | B2 * | 12/2011 | Yoda | B65H 5/224 271/197 |
| 9,370,943 | B2 * | 6/2016 | Hobo | B65H 5/224 |
| 10,683,180 | B2 * | 6/2020 | Serra Obiols | B65H 3/34 |
| 11,981,512 | B2 * | 5/2024 | Brown | B65G 15/30 |
| 2018/0201032 | A1 | 7/2018 | Hershfeld | |
| 2022/0267108 | A1 * | 8/2022 | Hoefnagels | B41J 11/0095 |

FOREIGN PATENT DOCUMENTS

| | | | |
|---|---|---|---|
| JP | 11-255392 | A | 9/1999 |
| JP | 2009-280320 | A | 12/2009 |

OTHER PUBLICATIONS

Office Action with the first search report for the corresponding TW Appln. 111130986 issued at Apr. 10, 2023.

* cited by examiner

CARDBOARD CONVEYOR DEVICE, CARDBOARD CONVEYING METHOD AND PLATE BODY STRUCTURE

TECHNICAL FIELD

The present disclosure relates to a cardboard conveyor device, a cardboard conveying method and a plate body structure, and particularly to, a cardboard conveyor device, a cardboard conveying method and a plate body structure, which can save power consumption of an aspirator because the plate body structure can form sub negative pressure regions communicative to a main negative pressure region.

RELATED ART

Refer to FIG. 1, FIG. 2A and FIG. 2B, FIG. 1 is a side sectional view of a cardboard conveyor device in related art, FIG. 2A is an enlarged view of a portion of the cardboard conveyor device in FIG. 1, and FIG. 2B is an enlarged view of another portion of the cardboard conveyor device in FIG. 1. Specifically, FIG. 2A is an enlarged view of a region AA of a cardboard conveyor device 900 in FIG. 1 while a cardboard P enters a conveyor belt 920 and covers a hole 922 of the conveyor belt 920, and FIG. 2B is an enlarged view of the region AA of the cardboard conveyor device 900 in FIG. 1 while the cardboard P enters the conveyor belt 920 but does not cover the hole 922 of the conveyor belt 920.

The cardboard conveyor device 900 comprises at least an aspirator 910, a conveyor belt 920, at least a plate body structure 930, at least a frame body 940, conveying rollers 950 and at least a cavity 960. The frame body 940 is configured to assemble with the aspirator 910, the plate body structure 930 and the conveying rollers 950, so as to fix the above components. The conveyor belt 920 is configured to assemble with the conveying rollers 950, so as to make the conveying rollers 950 drive the conveyor belt 920 to rotate, and the cardboard P disposed on the conveyor belt 920 is conveyed.

The plate body structure 930 has air holes 932, a surface of the conveyor belt 920 has holes 922, and the conveyor belt 920 is sleeved on the conveying rollers 950, and the conveyor belt 920 facing to the conveying side (i.e. upper side) is located on the plate body structure 930, so that the holes 922 of the conveyor belt 920 facing to the transmission side (i.e. upper side) are located above the air holes 932 of the plate body structure 930. In addition, the plate body structure 930 is further formed with interval spaces 934, each of the interval space 934 is located above the corresponding air hole 932 and below the corresponding hole 922, and a cross-sectional width of the air hole 932 is smaller than that of the interval space 934 and larger than that of the hole 922.

Interior of the cavity 960 is communicative to the air holes 932 of the plate body structure 930. The aspirator 910 is also communicative to the interior of the cavity 960 and is configured to evacuate to form a negative pressure area 970 in the interior of the cavity 960. In this way, the negative pressure airflow AF will be formed on the hole 922 of the conveyor belt 920 facing to the conveying side (i.e. upper side), and flow to the negative pressure area 970 through the interval space 934 and the air hole 932 of the plate body structure 930, so when the cardboard P is conveyed, the cardboard P will be sucked on the surface of the conveyor belt 920 facing to the conveying side (i.e. upper side).

When the negative pressure airflow AF is set to give the negative pressure to the cardboard P being conveyed, a wind speed of the negative pressure airflow AF in the hole 922 is also determined. For example, when the negative pressure is negative one kilopascal (−1 KPa), the wind speed of negative pressure airflow AF at hole 922 is about 37 meters per second (37 m/s). The hole 922 of FIG. 2A is covered by the cardboard P, and the wind speed of the negative pressure airflow AF at the hole 922 is 0, but for example, the hole 922 that is not covered by the cardboard P in FIG. 2B still needs to have a negative pressure airflow AF with a wind speed of 37 meters per minute. Therefore, on the whole, the power of the aspirator 910 will be wasted. In view of the global energy shortage problem and the environmental protection trend of energy saving and carbon saving, there is still a need in the industry for the cardboard conveyor device, method and plate body structure that can save the power consumption of the aspirator.

SUMMARY

To achieve one objective of the present disclosure, the present disclosure provides a cardboard conveyor device comprises at least one aspirator, a conveyor belt, at least a plate body structure, conveying rollers, at least a cavity and at least a frame body. A surface of the conveyor belt is configured to have holes. The plate body structure has wind shield structures, and the holes of the conveyor belt facing to a conveying side are located on the wind shield structures. The conveyor belt is sleeved on the conveying rollers, and a driving roller of the conveying rollers is configured to drive the conveyor belt to rotate to convey at least a cardboard on the conveyor belt facing to the conveying side. An interior of the cavity is communicative to the aspirator, and the aspirator is configured to evacuate to form a main negative pressure region in the interior of the cavity. The frame body is configured to assemble with the aspirator, the plate body structure, the conveying rollers and the cavity, so as to fix the aspirator, the plate body structure, the conveying rollers and the cavity. The plate body structure forms sub negative pressure regions, and the sub negative pressure regions are communicative to the main negative pressure region and provide a negative pressure to the cardboard on the conveyor belt facing to the conveying side.

According to the cardboard conveyor device, wherein the plate body structure further comprises a first plate body, the first plate body has air holes which penetrate the first plate body, so as to form the wind shield structures, and the two air holes are respectively on at least two sides of each of the wind shield structures, wherein the air holes are configured to make the sub negative pressure regions communicative to the main negative pressure region.

According to the cardboard conveyor device, wherein the plate body structure further comprises a second plate body and a third plate body, the first plate body is disposed between the second plate body and the third plate body, the second plate body is formed to have first interval spaces which penetrate the second plate body, the sub negative pressure regions are formed while the first interval spaces are communicative to the main negative pressure region, each of the first interval spaces is communicative to the corresponding air holes, the third plate body is formed to have second interval spaces which penetrate the third plate body, the second interval spaces are located between the corresponding sub negative pressure regions and the main negative pressure region, and communicative to the main negative pressure region and selectively communicative to the sub negative pressure regions, and the third plate body is further connected to the cavity.

According to the cardboard conveyor device, wherein the cardboard conveyor device further comprises at least a plate body controller. The plate body controller is configured to control at least a portion of the wind shield structures to displace, so as to make the portion of the plate body structures do not form the sub negative pressure regions.

According to the cardboard conveyor device, wherein the plate body structure is divided to have a main operation region, wherein the first plate body within the main operation region is fixed.

According to the cardboard conveyor device, wherein the plate body structure is further divided to have two extension operation regions respectively on two sides of the main operation region, and the cardboard conveyor device further comprises at least a plate body controller. One end of the plate body controller is connected to the first plate body, the plate body controller controls the first plate body within the two extension operation regions to displace, thus making the air holes of the first plate body within the two extension operation regions not communicative to the first interval spaces and the second interval spaces, and prohibiting the sub negative pressure regions to be formed within the extension operation regions.

To achieve one objective of the present disclosure, present disclosure provides a cardboard conveying method. The cardboard conveying method comprises steps as follows. Firstly, a cardboard conveyor device is provided, wherein the cardboard conveyor device comprises at least an aspirator, a conveyor belt having holes on a surface of the conveyor belt, at least a plate body structure having wind shield structures, conveying rollers, at least a frame body and a cavity having an interior communicative to the aspirator, when the aspirator is activated to evacuate, the interior of the cavity forms a main negative pressure region, the plate body structure forms sub negative pressure regions, and the sub negative pressure regions are communicative to the main negative pressure region, thus providing a negative pressure to at least a cardboard on the conveyor belt facing to a conveying side. Then, the aspirator and a motor connected to the conveying rollers are activated, so as to drive the conveying rollers to rotate, and to drive the conveyor belt to convey the cardboard on the conveyor belt facing to the conveying side, such that the main negative pressure region provides the negative pressure the cardboard on the conveyor belt facing to the conveying side via the sub negative pressure regions.

According to the cardboard conveying method, wherein the plate body structure further comprises a first plate body, the first plate body has air holes which penetrate the first plate body, so as to form the wind shield structures, and the two air holes are respectively on at least two sides of each of the wind shield structures, wherein the air holes are configured to make the sub negative pressure regions communicative to the main negative pressure region.

According to the cardboard conveying method, wherein the plate body structure further comprises a second plate body and a third plate body, the first plate body is disposed between the second plate body and the third plate body, the second plate body is formed to have first interval spaces which penetrate the second plate body, the sub negative pressure regions are formed while the first interval spaces are communicative to the main negative pressure region, each of the first interval spaces is communicative to the corresponding air holes, the third plate body is formed to have second interval spaces which penetrate the third plate body, the second interval spaces are located between the corresponding sub negative pressure regions and the main negative pressure region, and communicative to the main negative pressure region, and the third plate body is further connected to the cavity.

According to the cardboard conveying method, wherein the cardboard conveyor device further comprises at least a plate body controller. The plate body controller is configured to control at least a portion of the wind shield structures to displace, so as to make the portion of the plate body structures do not form the sub negative pressure regions.

According to the cardboard conveying method, wherein the plate body structure is divided to have a main operation region, wherein the first plate body within the main operation region is fixed.

According to the cardboard conveying method, wherein the plate body structure is further divided to have two extension operation regions respectively on two sides of the main operation region, and the cardboard conveyor device further comprises at least a plate body controller. One end of the plate body controller is connected to the first plate body, the plate body controller controls the first plate body within the two extension operation regions to displace, thus making the air holes of the first plate body within the two extension operation regions not communicative to the first interval spaces and the second interval spaces, and prohibiting the sub negative pressure regions to be formed within the extension operation regions.

According to the cardboard conveying method, wherein the cardboard conveying method further comprises a step as follows. The plate body controller is used to control the first plate body within the extension operation regions to displace, such that the air holes of the first plate body within the extension operation regions are masked and not communicative to the main negative pressure region and the sub negative pressure regions.

To achieve one objective of the present disclosure, present disclosure provides a plate body structure used in a cardboard conveyor device, which comprises a first plate body, a second plate body and a third plate body. The first plate body has air holes which penetrate the first plate body, so as to form the wind shield structures, and the two air holes are respectively on at least two sides of each of the wind shield structures. The air holes are configured to make sub negative pressure regions of a cardboard conveyor device communicative to the main negative pressure region of the cardboard conveyor device. The second plate body is formed to have first interval spaces which penetrate the second plate body. The third plate body is formed to have second interval spaces which penetrate the third plate body. The first plate body is disposed between the second plate body and the third plate body, each of the first interval spaces is communicative to the corresponding air holes, the sub negative pressure regions are formed while the first interval spaces are communicative to the main negative pressure region, and the second interval spaces are located between the corresponding sub negative pressure regions and the main negative pressure region, and communicative to the main negative pressure region and selectively communicative to the sub negative pressure regions.

According to the plate body structure, wherein the plate body structure is divided to have a main operation region, wherein the first plate body within the main operation region is fixed.

According to the plate body structure, wherein the plate body structure is further divided to have two extension operation regions respectively on two sides of the main operation region, and the first plate body within the two extension operation regions is controlled by at least a plate body controller of a cardboard conveyor device to displace, thus prohibiting the sub negative pressure regions to be formed within the extension operation regions.

In short, an embodiment of the present disclosure provides a cardboard conveyor device, a cardboard conveying method and a plate body structure, which can save power consumption of an aspirator because the plate body structure can form sub negative pressure regions communicative to a main negative pressure region.

BRIEF DESCRIPTION OF DRAWINGS

The present disclosure can be more fully understood by reading the subsequent detailed description and examples with references made to the accompanying drawings, wherein dimensions and arrangement configurations in the drawings are for illustration only, and the present disclosure is not limited thereto. Each figure of the drawings is briefly illustrated as follows.

DETAILS OF EXEMPLARY EMBODIMENTS

The following description is of the best-contemplated mode of carrying out the present disclosure. This description is made for the purpose of illustrating the general principles of the present disclosure and should not be taken in a limiting sense. The scope of the present disclosure is best determined by reference to the appended claims.

An embodiment of the present disclosure provides a cardboard conveyor device, a cardboard conveying method and a plate body structure, which can save power consumption of an aspirator because the plate body structure can form sub negative pressure regions communicative to a main negative pressure region. Specifically, the plate body structure is formed by three layers of plate bodies, a plate body of a middle layer has air holes, a plate body of an upper layer has first interval spaces penetrating the plate body of the upper layer, and a plate body of a lower layer has second interval spaces penetrating the plate body of the lower layer. Each of the first interval spaces is communicative to the corresponding air holes and the corresponding second interval space, and the second interval spaces are communicative to the main negative pressure region. Thus, the sub negative pressure regions can provide a negative pressure to a cardboard being conveyed, and regarding the holes corresponding to the first interval space which are not covered by the cardboard, a wind speed of the negative pressure airflow which passes the holes can be reduced, which can save the power consumption of the aspirator.

Further, in one embodiment, the plate body structure is divided to have a main operation region and two extension operation regions on two sides of the main operation region. The plate body of the middle layer within the main operation region is fixed, and the plate body of the middle layer within the two extension operation regions are movable, such that the sub negative pressure regions can be selectively not formed within the two extension operation regions. When a size of the cardboard is small (i.e. less than a size of the main operation region), the sub negative pressure regions are selectively not formed within the extension operation regions. When the size of the cardboard is large (i.e. larger than the size of the main operation region), the sub negative pressure regions are selectively formed within the extension operation regions. In this way, the cardboard conveyor device is able to convey the cardboards of different sizes.

Figure 1:
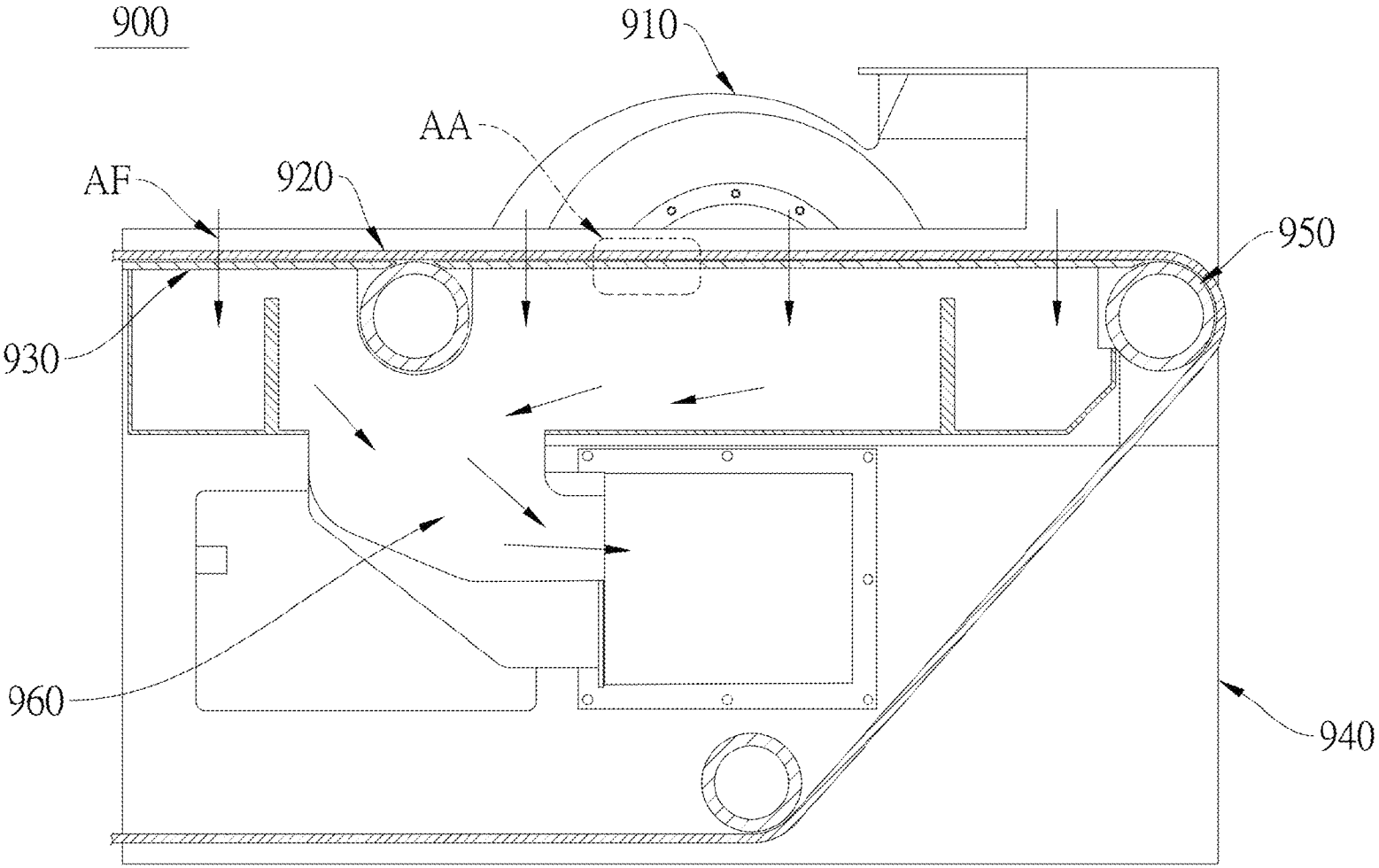
FIG. 1 is a side sectional view of a cardboard conveyor device in related art.
Figure 2B:
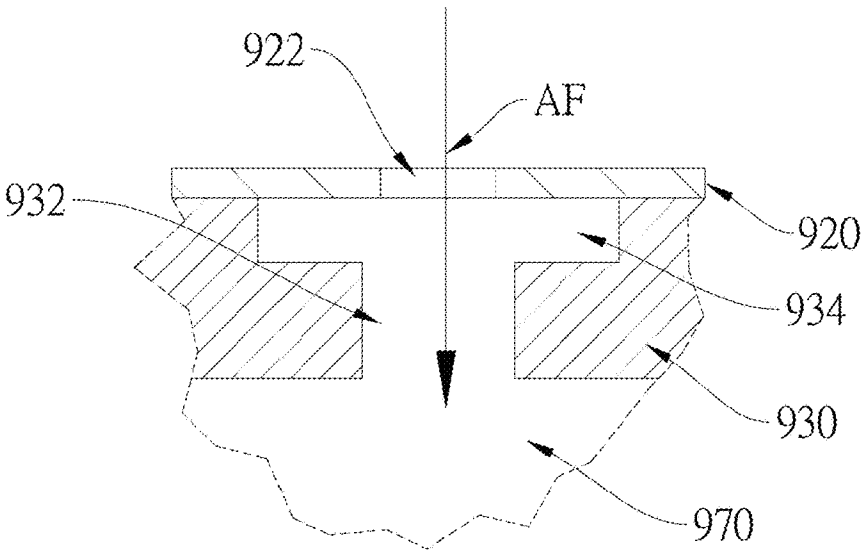
FIG. 2B is an enlarged view of another portion of the cardboard conveyor device in FIG. 1.
Figure 2A:
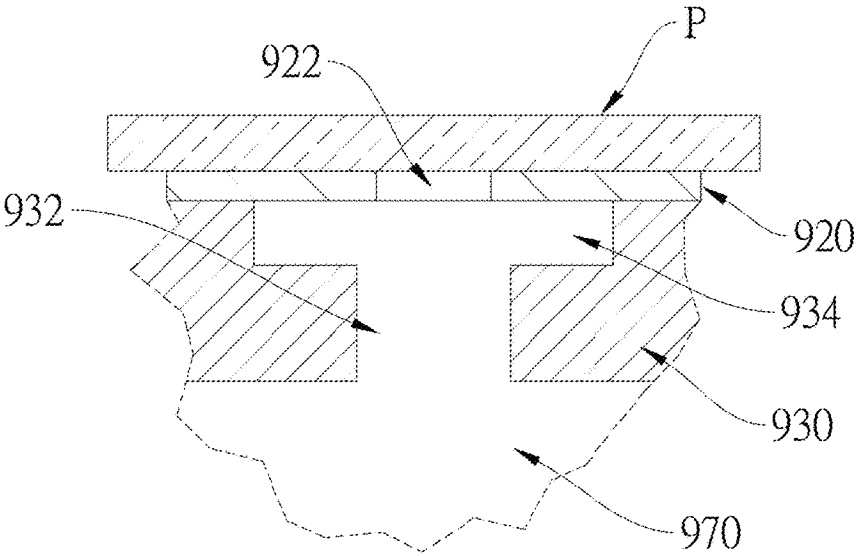
FIG. 2A is an enlarged view of a portion of the cardboard conveyor device in FIG. 1.
Figure 3:
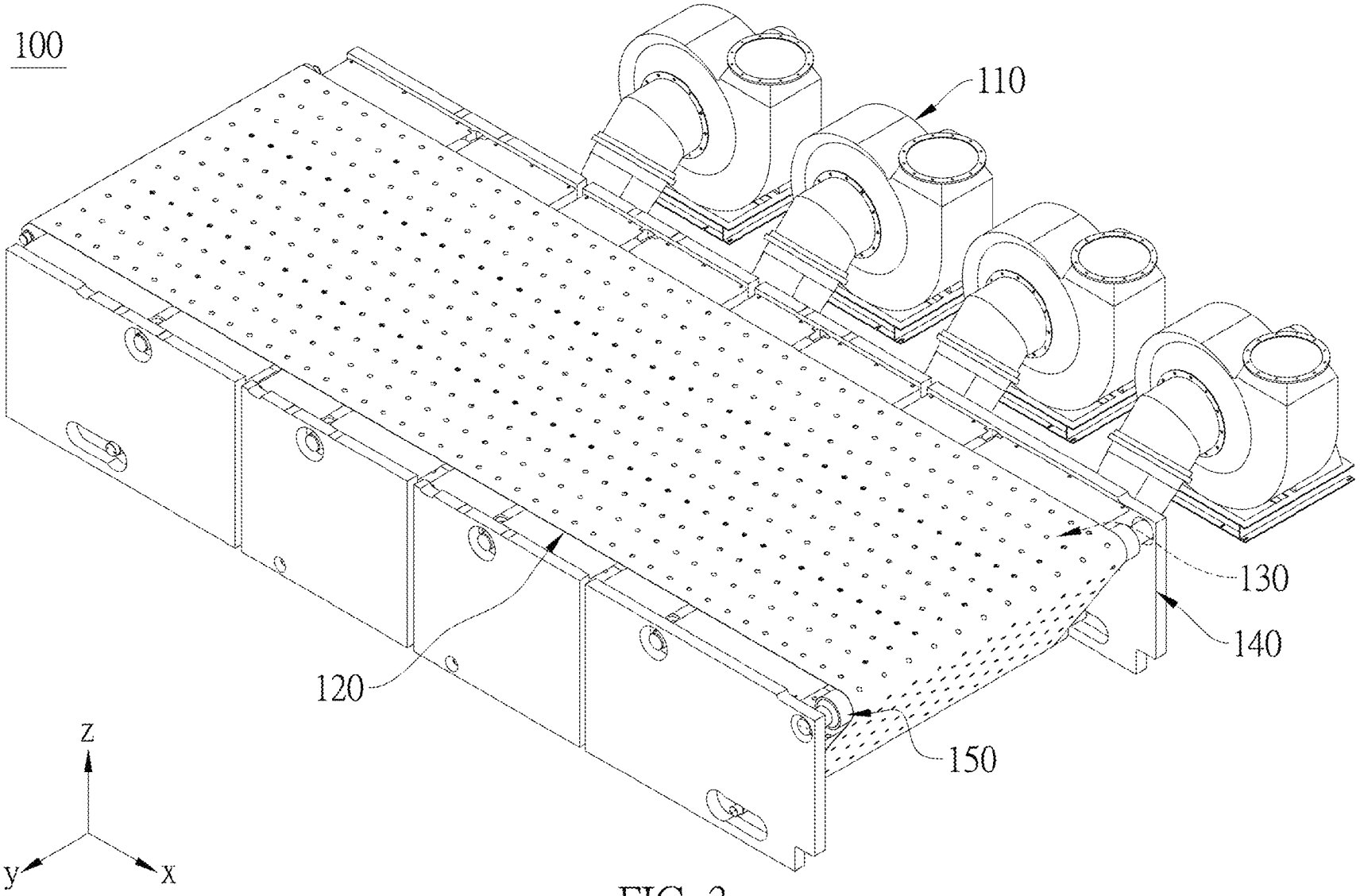
FIG. 3 is a three dimensional view of a cardboard conveyor device according to an embodiment of the present disclosure.
Figure 4:
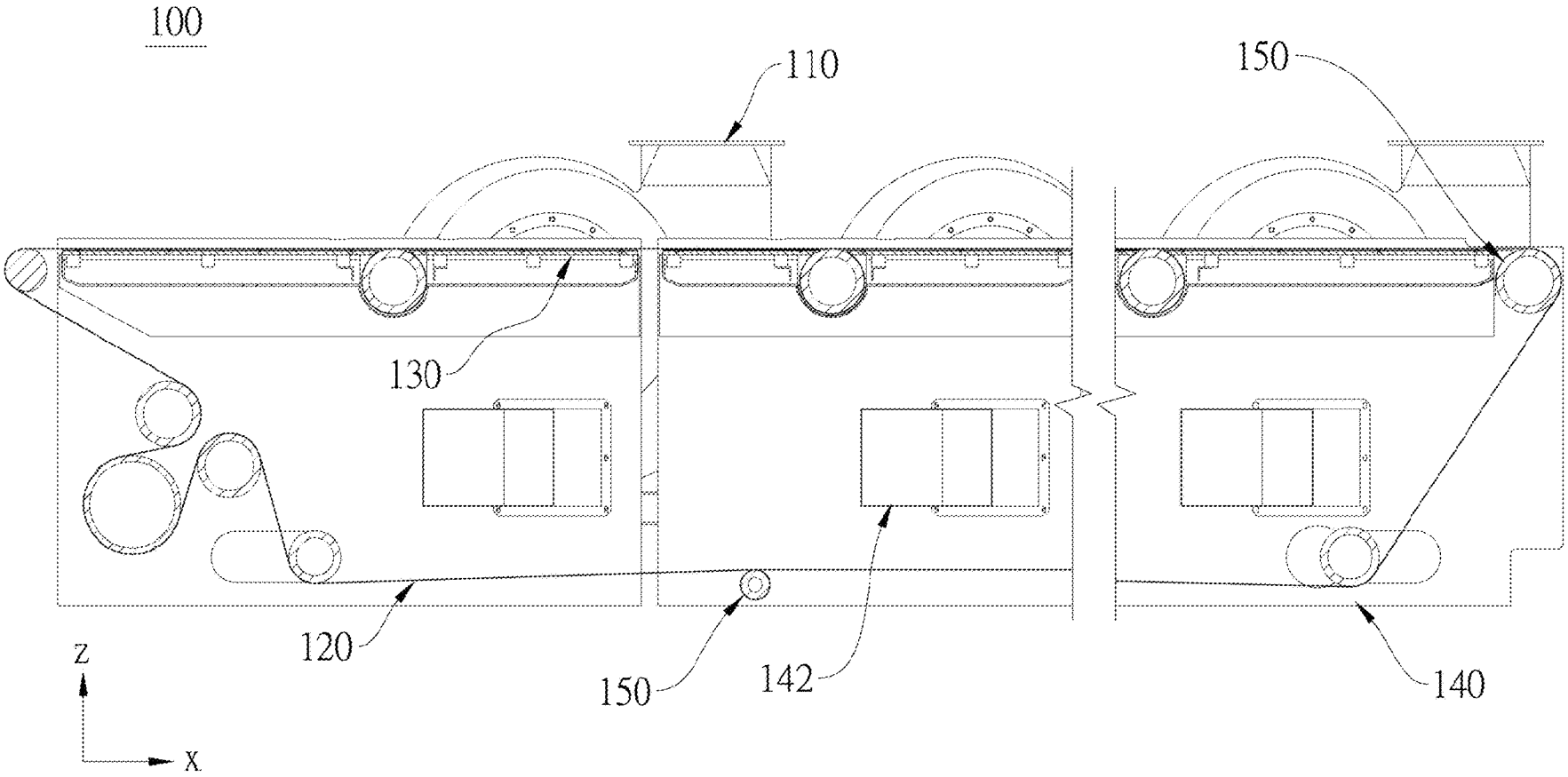
FIG. 4 is a side sectional view of a cardboard conveyor device according to an embodiment of the present disclosure.
Figure 5:
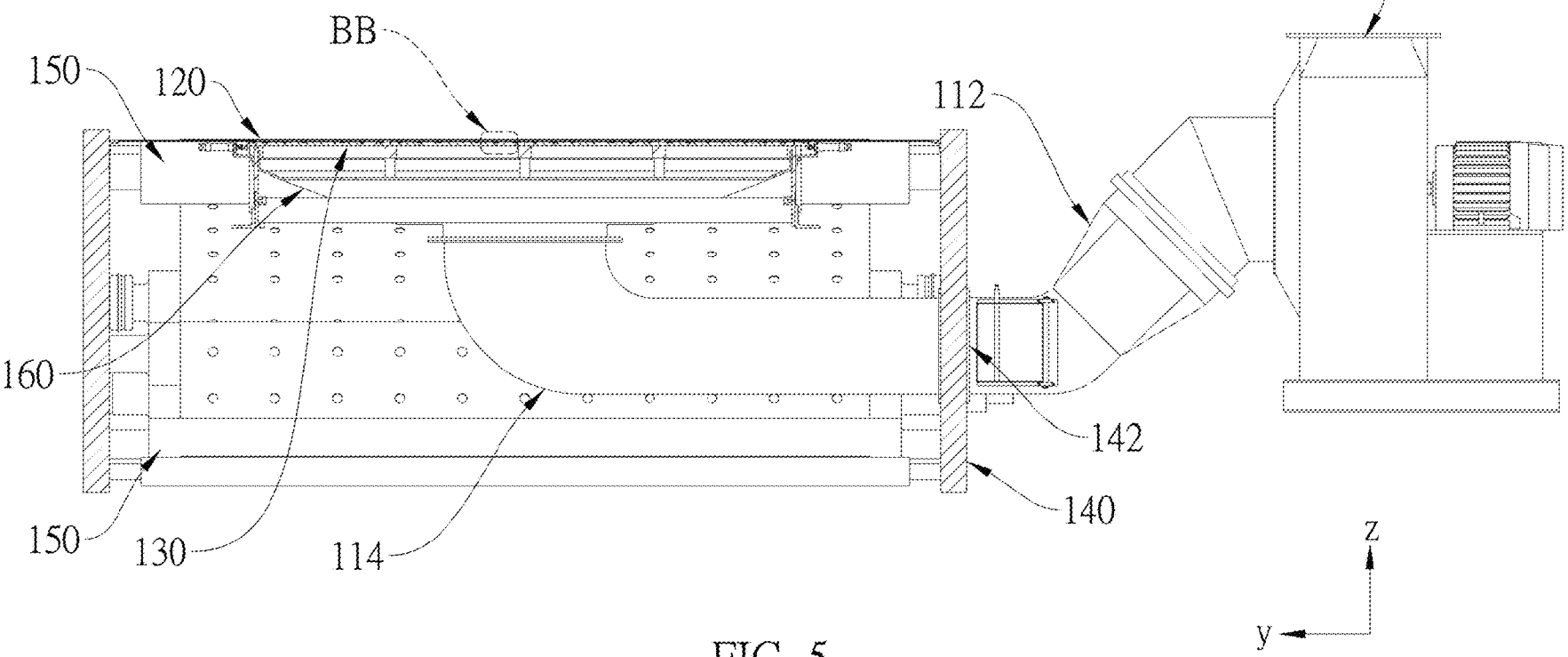
FIG. 5 is another side sectional view of a cardboard conveyor device according to an embodiment of the present disclosure.
Figure 6:
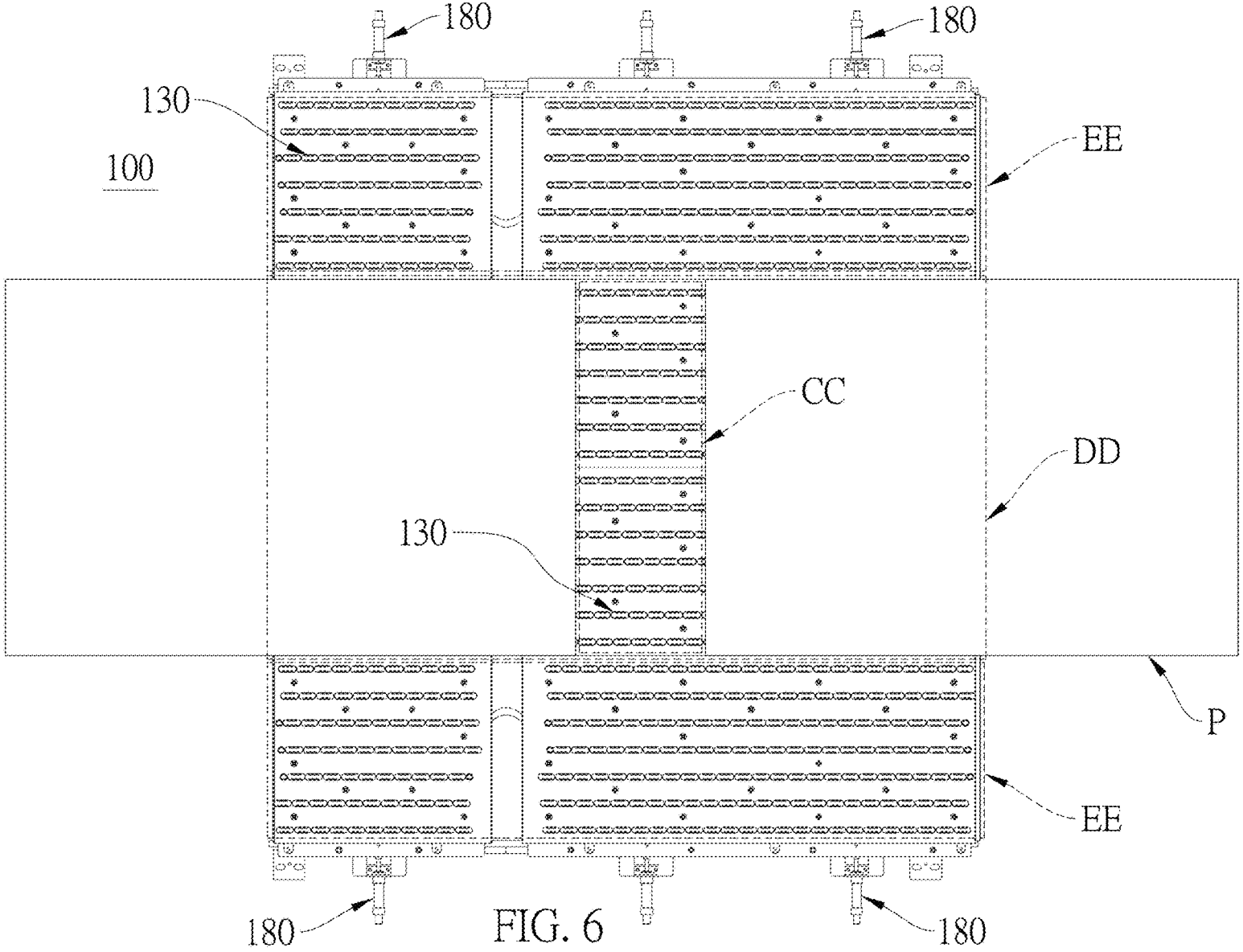
FIG. 6 is a top view of a cardboard conveyor device according to an embodiment of the present disclosure.
Figure 7B:
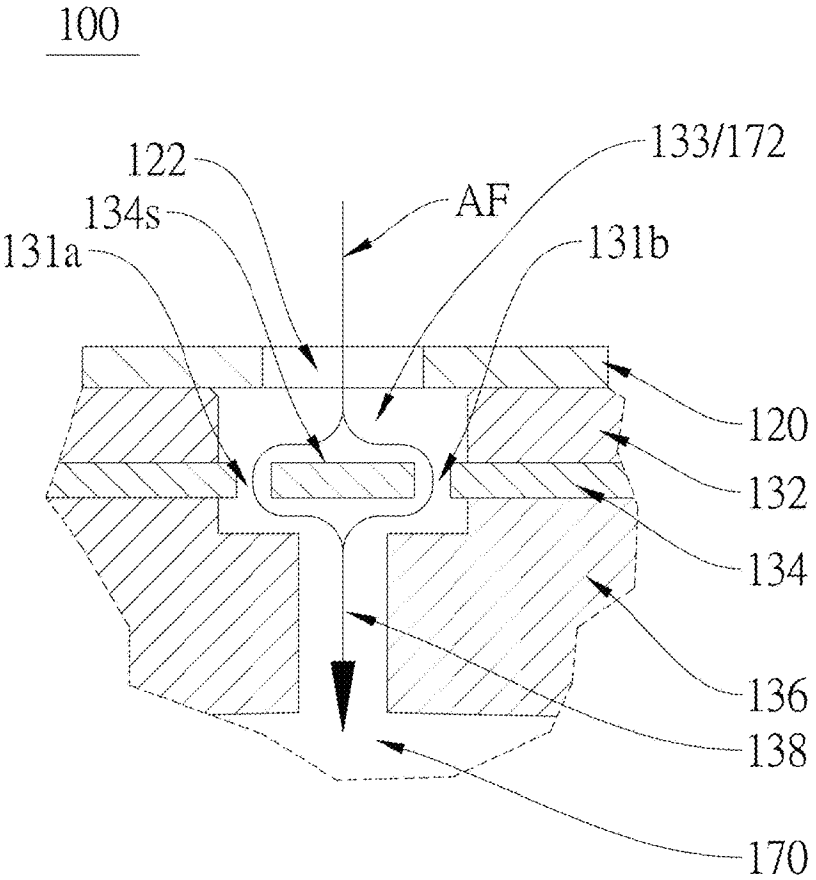
FIG. 7B is an enlarged view of another portion of the cardboard conveyor device in FIG. 5.
Figure 7A:
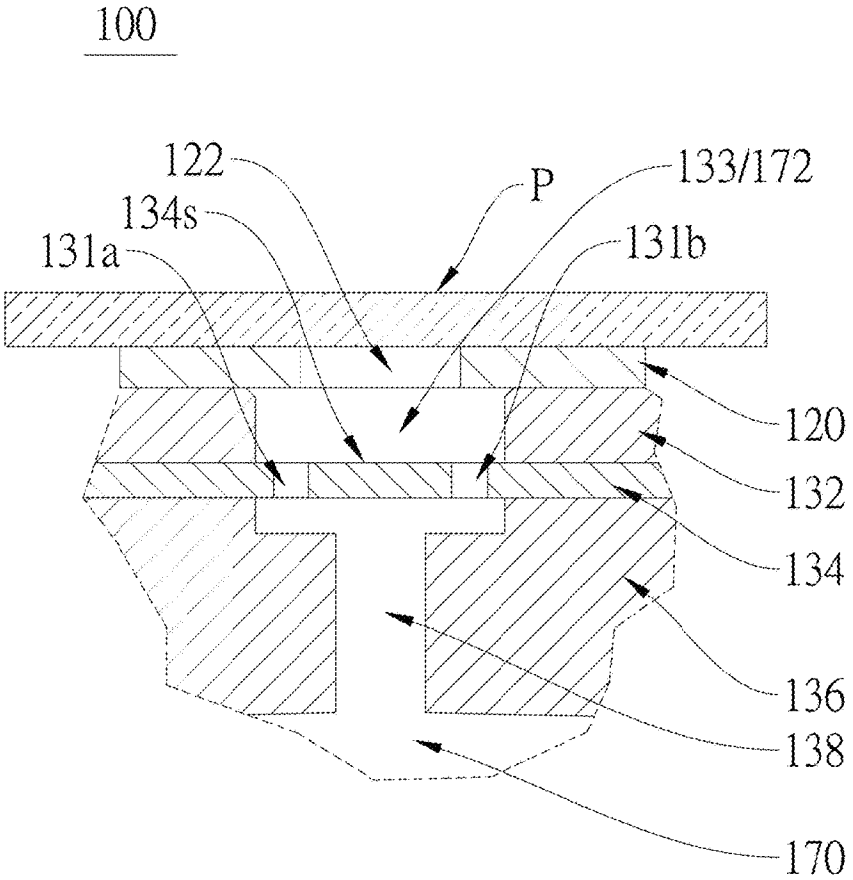
FIG. 7A is an enlarged view of a portion of the cardboard conveyor device in FIG. 5.

Firstly, refer to FIG. 3 through FIG. 7B, FIG. 3 is a three dimensional view of a cardboard conveyor device according to an embodiment of the present disclosure, FIG. 4 is a side sectional view of a cardboard conveyor device according to an embodiment of the present disclosure, FIG. 5 is another side sectional view of a cardboard conveyor device according to an embodiment of the present disclosure, FIG. 6 is a top view of a cardboard conveyor device according to an embodiment of the present disclosure, FIG. 7A is an enlarged view of a portion of the cardboard conveyor device in FIG. 5, and FIG. 7B is an enlarged view of another portion of the cardboard conveyor device in FIG. 5. Specifically, FIG. 7A is an enlarged view of a region BB of a cardboard conveyor device 100 in FIG. 5 while a cardboard P enters a conveyor belt 120 and covers air holes 131*a* and 131*b*, and FIG. 7B is an enlarged view of a region BB of a cardboard conveyor device 100 in FIG. 5 while the cardboard P enters the conveyor belt 120 but does not cover air holes 131*a* and 131*b*. That is, FIG. 7A and FIG. 7B are enlarged views of the region BB in FIG. 5 at different times. For example, in a region CC of FIG. 6, the cardboard P does not cover air holes 131*a* and 131*b*.

Figure 8:
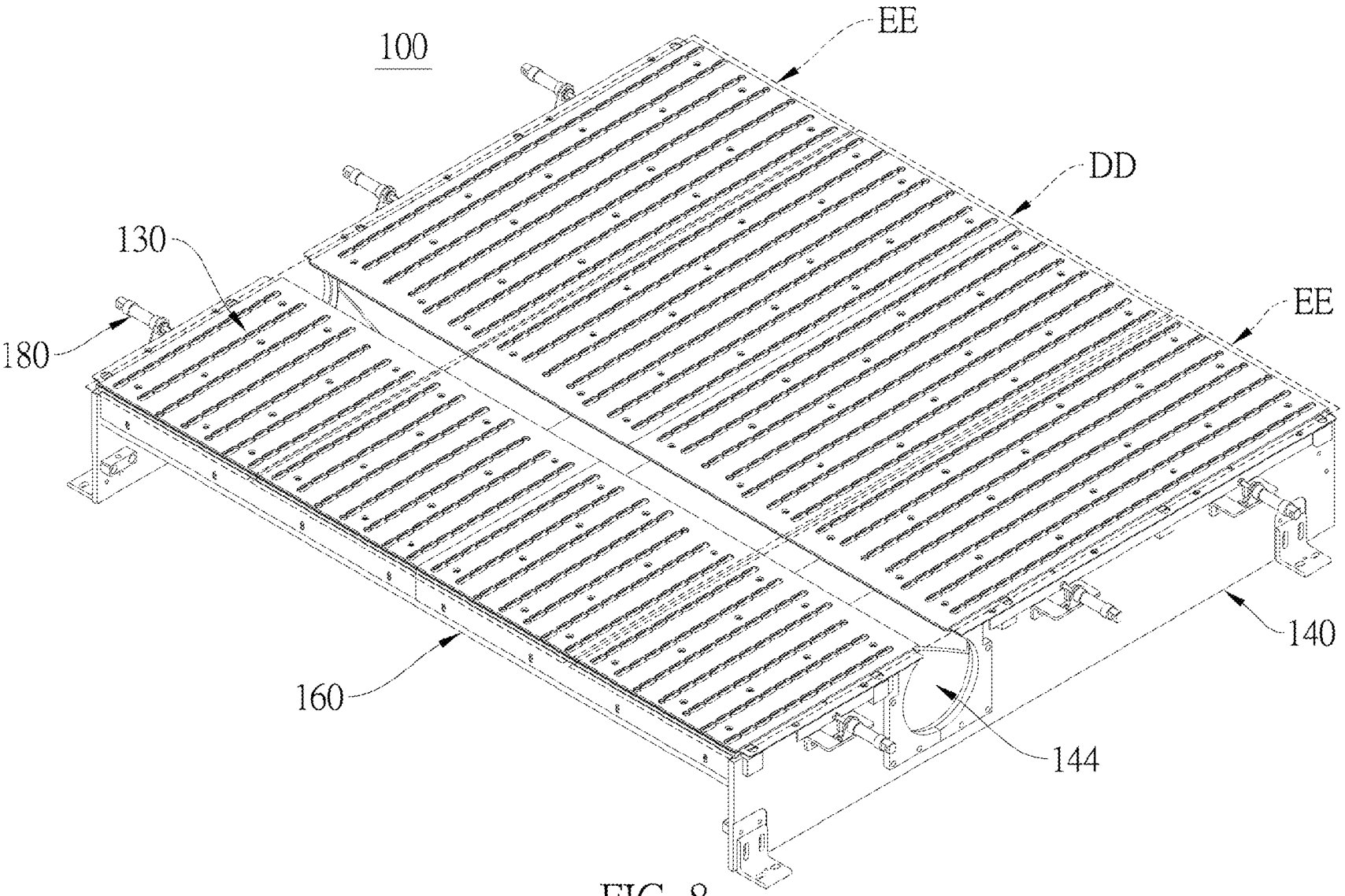
FIG. 8 is a three dimensional view of a plate body structure, a cavity, a frame body and a plate body controller of a cardboard conveyor device according to an embodiment of the present disclosure.

The cardboard conveyor device 100 comprises at least an aspirator 110, a conveyor belt 120, a plate body structure 130, conveying rollers 150, at least a cavity 160 and at least a frame body 140. A surface of the conveyor belt 120 has holes 122. The plate body structure 130 has wind shield structures 134*s*, and the holes 122 of the conveyor belt 120 facing to a conveying side (i.e. upper side) are located on the wind shield structures 134*s*. The conveyor belt 120 is sleeved on the conveying rollers 150, the conveying rollers 150 comprises at least a driving roller which is configured to drive the conveyor belt 120 to rotate, so as to convey at least the cardboard P on the conveyor belt 120 facing to the conveying side (i.e. upper side). The conveying rollers 150 further comprises idler rollers. As shown in FIG. 4, the conveyor belt 120 is circularly sleeved on the conveying rollers 150. By the way, as shown in FIG. 8, the frame body 140 has roller slots 144 which are configured to receive the conveying rollers 150.

An interior of the cavity 160 is communicative to the aspirator 110, and the aspirator 110 is configured to evacuate to form a main negative pressure region 170 in the interior of the cavity 160. The cavity 160 is further connected to the corresponding plate body structure 130. In the embodiment, the number of the aspirator 110, the number of the cavity 160 and the number of the plate body structure 130 are four, and the present disclosure is not limited thereto. The frame body 140 is configured to assemble with the aspirator 110, the plate body structure 130, the conveying rollers 150 and the cavity 160, so as to fix the aspirator 110, the plate body structure 130, the conveying rollers 150 and the cavity 160. Further, the number of the frame body 140 is eight, wherein the frame body which is close to the aspirator 110 has an exhaust tube opening 142, and exhaust tubes 112, 114 of the aspirator 110 are connected to each other at a position of the exhaust tube opening 142. Two ends of the exhaust tube 112 are respectively connected to the aspirator 110 and fixed to the exhaust tube opening 142, and two ends of the exhaust tube 114 are respectively fixed to the exhaust tube opening 142 and a bottom part of the cavity 160, such that the interior of the cavity 160 is communicative to the aspirator 110.

The plate body structure 130 at least comprises a plate body 134, the plate body 134 has air holes 131*a*, 131*b*, both of which penetrate the plate body 134, so as to form wind shield structures 134*s*. As shown in FIG. 7A and FIG. 7B, each of the wind shield structures 134*s* has the two air holes 131*a*, 131*b* on at least two sides of the wind shield structure 134. That is, two air holes 131*a*, 131*b* define a wind shield structure 134*s*. As shown in FIG. 7A and FIG. 7B, each two air holes 131*a*, 131*b* are communicative to the sub negative pressure region 172 (formed in an interval space 133 of the plate body 132) and the main negative pressure region 170. In other words, by using a design of the wind shield structures 134*s*, when the air holes 131*a*, 131*b* are communicative to the main negative pressure region 170 and the interval space 133 of the plate body 132, the plate body structure 130 forms sub negative pressure regions 172, and the sub negative pressure regions 172 are configured to provide a negative pressure to the cardboard P on the conveyor belt 120 facing to the conveying side.

Specifically, the plate body structure 130 further comprises plate bodies 132, 136. The plate body 134 is disposed between the plate bodies 132, 136. The plate body 132 is formed with interval spaces 133, all of which penetrate the plate body 132. When each of the interval spaces 133 is communicative to the main negative pressure region 170 via the air holes 131*a*, 131*b*, the interval spaces 133 form the sub negative pressure regions 172. The plate body 136 is formed with interval spaces 138, all of which penetrate the plate body 136. Each of the interval spaces 138 is located between the corresponding sub negative pressure region 172 and the main negative pressure region 170, and selectively communicative to the sub negative pressure region 172 and communicative to the main negative pressure region 170. Further, the plate body 136 is connected to the cavity 160, and in the embodiment, a shape of the interval space 138 is T-shaped. By the way, the plate body structure 130 of the present disclosure is not limited to be formed by the plate bodies 132, 134, 136 of three layers, and other implementations of the plate body structure 130 which is able to form sub negative pressure regions 172 can also be used in the present disclosure.

As shown in FIG. 7A, when the cardboard P covers the interval spaces 133, 138 and the corresponding sub negative pressure region 172 (i.e. the air holes 131*a*, 131*b* are covered), the sub negative pressure region 172 provides the negative pressure to the cardboard P being conveyed, such that the cardboard P can sucked on the surface of the conveyor belt 120 facing to the conveying side (i.e. upper side), and the conveyor belt 120 can convey the cardboard P successfully. As shown in FIG. 7B, when the cardboard P does not cover the interval spaces 133, 138 and the corresponding sub negative pressure region 172 (i.e. the air holes 131*a*, 131*b* are not covered), to main the negative pressure provided to the cardboard P which covers the interval spaces 133, 138 and the corresponding sub negative pressure region 172, the sub negative pressure region 172 not covered by the cardboard P needs to provide a negative pressure airflow AF. Because of existence of the sub negative pressure regions 172, when the negative pressure is negative one kilopascal (−1 KPa), a wind speed of negative pressure airflow AF flowing through hole 122 on the interval space 133 can be reduced from 37 meters per second (37 m/s) to 15 meters per second (15 m/s), so that the power consumption of the aspirator 110 can be saved.

The plate body structure 130 can be divided to have a main operation region DD and two extension operation regions EE on two sides of the main operation region DD. Generally speaking, when a width of the cardboard P is less than or equal to a width of the main operation region DD, it merely needs the main operation region DD to provide the negative pressure to the cardboard. When the width of the cardboard P is larger than the width of the main operation region DD, it further needs the two extension operation regions EE to provide the negative pressure to the cardboard. Thus, the plate body 134 within the main operation region DD is designed to be fixed and to form the sub negative pressure regions 172, and the plate body 134 within the main operation regions DD are designed to be movable, such that the extension operation regions EE can selectively form the sub negative pressure regions 172 or electively not form the sub negative pressure regions 172.

Figure 9A:
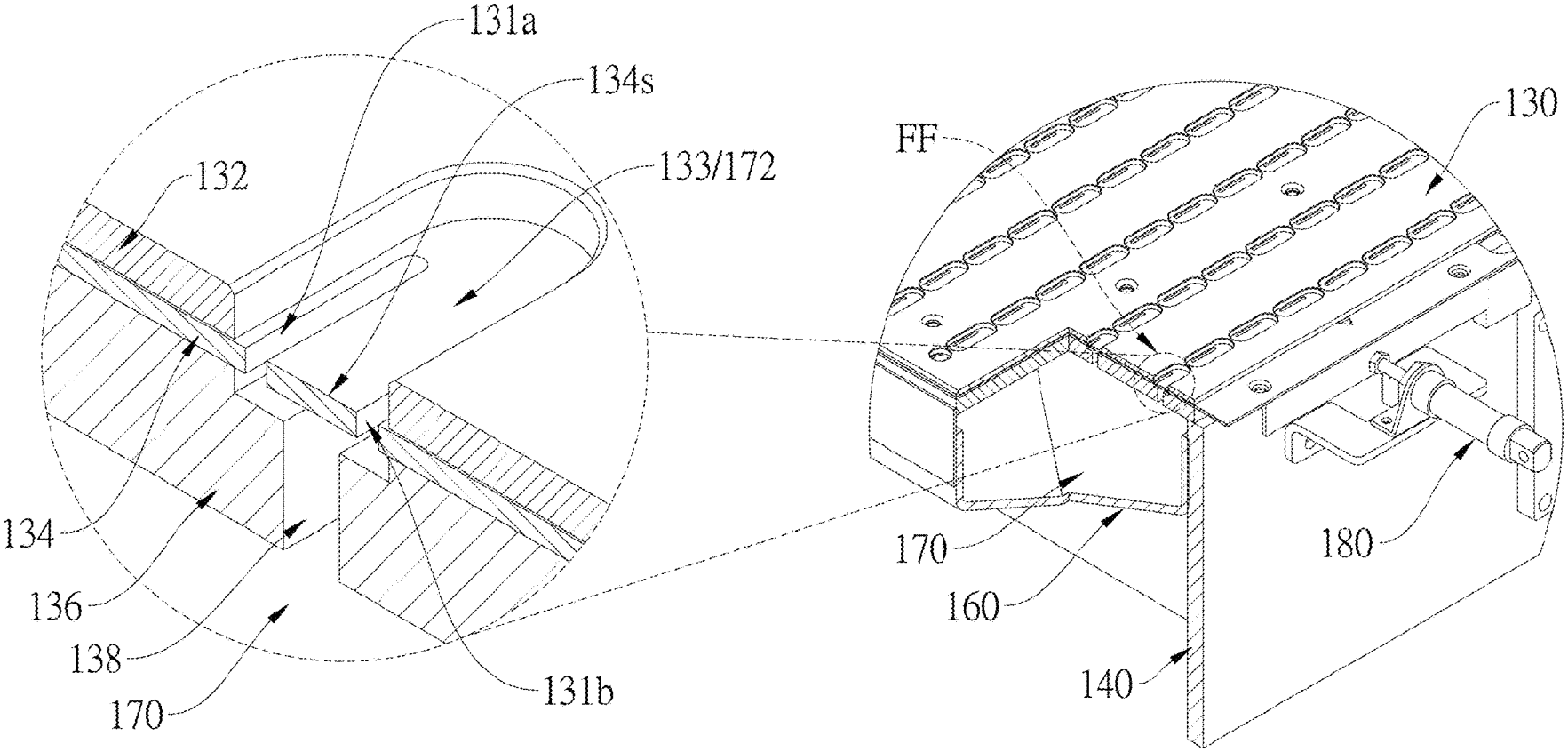
FIG. 9A is a three dimension sectional view of a plate body structure, a cavity, a frame body and a plate body controller of a cardboard conveyor device in a first state according to an embodiment of the present disclosure.
Figure 9B:
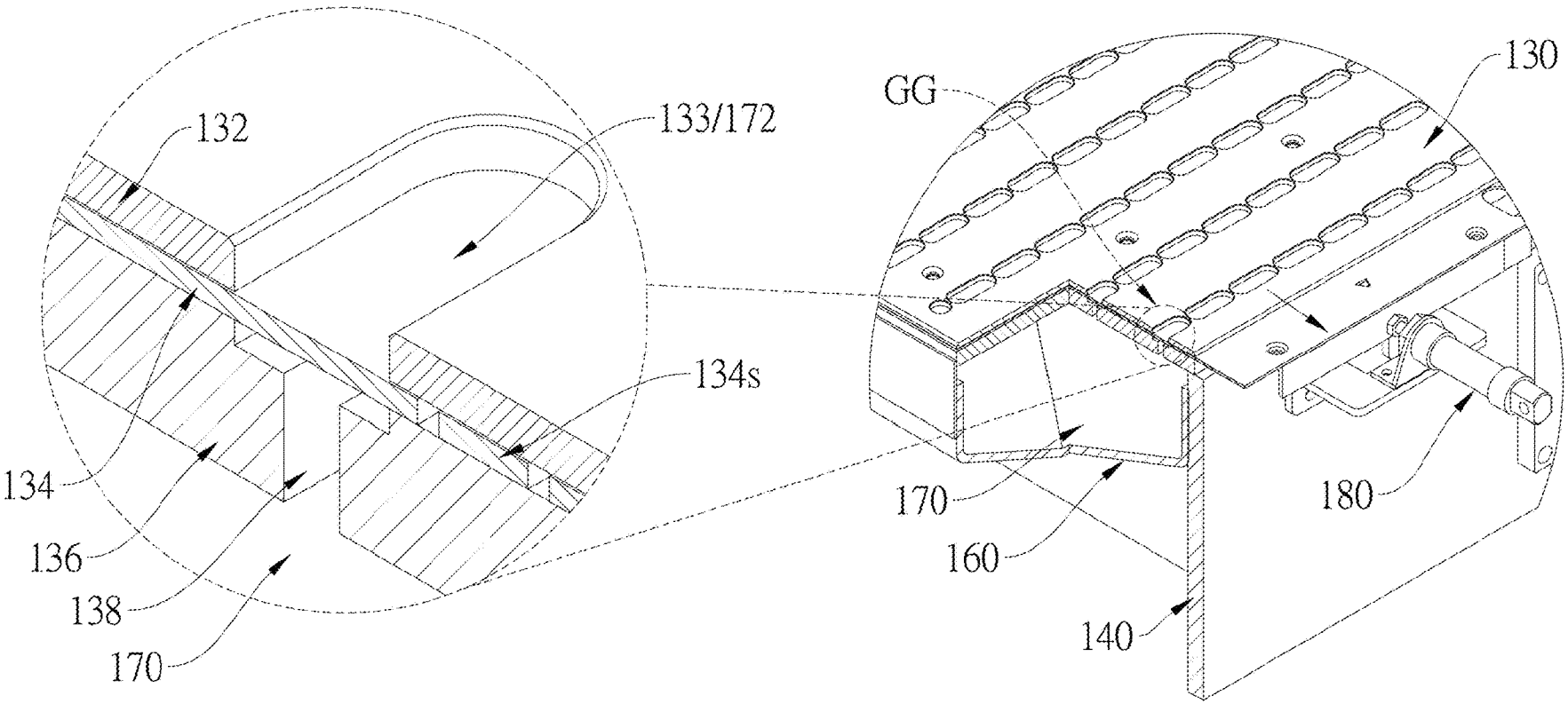
FIG. 9B is a three dimension sectional view of a plate body structure, a cavity, a frame body and a plate body controller of a cardboard conveyor device in a second state according to an embodiment of the present disclosure.

Further, refer to FIG. 6, FIG. 8, FIG. 9A and FIG. 9B at the same time, FIG. 8 is a three dimensional view of a plate body structure, a cavity, a frame body and a plate body controller of a cardboard conveyor device according to an embodiment of the present disclosure, FIG. 9A is a three dimension sectional view of a plate body structure, a cavity, a frame body and a plate body controller of a cardboard conveyor device in a first state according to an embodiment of the present disclosure, and FIG. 9B is a three dimension sectional view of a plate body structure, a cavity, a frame body and a plate body controller of a cardboard conveyor device in a second state according to an embodiment of the present disclosure. The enlarged views of regions FF, GG in FIG. 9A and FIG. 9B are also depicted in FIG. 9A and FIG. 9B, such that the details of the plate body 134 can be obviously seen.

The cardboard conveyor device 100 further comprises a plate body controller 180. One end of the plate body controller 180 is connected to the plate body 134, so as to control the plate body 134 within the extension operation regions EE to displace. A first state of the cardboard conveyor device 100 can be seen in FIG. 9A, wherein the air holes 131*a*, 131*b* of the plate body 134 within the extension operation regions EE are not masked or blocked by the plate bodies 132 and 136; and a second state of the cardboard conveyor device 100 can be seen in FIG. 9B, wherein the air holes 131*a*, 131*b* of the plate body 134 within the extension operation regions EE are masked or blocked by the plate bodies 132 and 136. The plate body controller 180 can control the plate body 134 within the extension operation regions EE to displace, such that the air holes 131*a*, 131*b* of the plate body 134 within the extension operation regions EE are masked or blocked by the plate bodies 132 and 136, such that the air holes 131*a*, 131*b* of the plate body 134 within the extension operation regions EE are not communicative to the interval spaces 133, 138 and the main negative pressure region 170, and the interval spaces 133 do not form the sub negative pressure regions 172. In short, the plate body controller 180 can control the movement of the wind shield structures 134*s* so that at least a part of the plate body structure 130 is not formed with the sub negative pressure regions 172.

Also, refer to FIG. 3 through FIG. 9B, according to the above descriptions, the present disclosure further provides a cardboard conveying method which has steps described as follows. Firstly, the cardboard conveyor device 100 is provided, wherein when the aspirator 110 is activated to evacuate, the interior of the cavity 160 forms a main negative pressure region 170, the plate body structure 130 forms sub negative pressure regions 172, and the sub negative pressure regions 172 are communicative to the main negative pressure region 170, thus providing a negative pressure to at least a cardboard P on the conveyor belt 120 facing to the conveying side. Next, the aspirator 110 and a motor (not depicted in drawings) connected to the conveying rollers 150 are activated, so as to drive the conveying rollers 150 to rotate, and to drive the conveyor belt 120 to convey the cardboard P on the conveyor belt 120 facing to the conveying side, such that the main negative pressure region 170 provides the negative pressure the cardboard P on the conveyor belt 120 facing to the conveying side via the sub negative pressure regions 172. Moreover, if the plate body structure 130 is designed to be divided to have the main operation region DD and the two extension operation regions EE on the two sides of the main operation region DD, the cardboard conveying method can further comprise step of "using the plate body controller 180 to control the first plate body 134 within the extension operation regions EE to displace, such that the air holes 131*a*, 131*b* of the first plate body 134 within the extension operation regions EE are masked and not communicative to the main negative pressure region 170 and the sub negative pressure regions 172".

To sum up, embodiments of the present disclosure provide a cardboard conveyor device, a cardboard conveying method and a plate body structure, which can save power consumption of an aspirator because the plate body structure can form sub negative pressure regions communicative to a main negative pressure region, the sub negative pressure regions can provide the negative pressure to the cardboard being conveyed, and the wind speed of the negative pressure airflow flowing through the air holes which are not covered by the cardboard can be reduced. Further, the plate body structure can be designed to be divided to have the main operation region and the two extension operation regions on the two sides of the main operation region, and the two extension operation regions can selectively not form the sub negative pressure regions. That is, merely when the size of the cardboard is large, it needs the extension operation regions form the sub negative pressure regions, which can further save the power consumption of the aspirator 110.

While the present disclosure has been described by way of example and in terms of preferred embodiment, it is to be understood that the present disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

The invention claimed is:

1. A cardboard conveyor device, comprising:

at least one aspirator;

a conveyor belt, wherein a surface of the conveyor belt is configured to have holes;

at least a plate body structure, wherein the plate body structure has wind shield structures, the holes of the conveyor belt facing to a conveying side are located on the wind shield structures;

conveying rollers, wherein the conveyor belt is sleeved on the conveying rollers, a driving roller of the conveying rollers is configured to drive the conveyor belt to rotate to convey at least a cardboard on the conveyor belt facing to the conveying side;

at least a cavity, wherein an interior of the cavity is communicative to the aspirator, the aspirator is configured to evacuate to form a main negative pressure region in the interior of the cavity;

at least a frame body, wherein the frame body is configured to assemble with the aspirator, the plate body structure, the conveying rollers and the cavity, so as to fix the aspirator, the plate body structure, the conveying rollers and the cavity; and at least a plate body controller, configured to control at least a portion of the wind shield structures to displace, so as to make the portion of the plate body structures do not form the sub negative pressure regions, wherein the plate body structure forms sub negative pressure regions, and the sub negative pressure regions are communicative to the main negative pressure region and provide a negative pressure to the cardboard on the conveyor belt facing to the conveying side.

2. The cardboard conveyor device of claim 1, wherein the plate body structure further comprises a first plate body, the first plate body has two air holes which penetrate the first plate body, so as to form the wind shield structures, and the two air holes are respectively on at least two sides of each of the wind shield structures, wherein the two air holes are configured to make the sub negative pressure regions communicative to the main negative pressure region.

3. The cardboard conveyor device of claim 2, wherein the plate body structure further comprises a second plate body and a third plate body, the first plate body is disposed between the second plate body and the third plate body, the second plate body is formed to have first interval spaces which penetrate the second plate body, the sub negative pressure regions are formed while the first interval spaces are communicative to the main negative pressure region, each of the first interval spaces is communicative to the corresponding two air holes, the third plate body is formed to have second interval spaces which penetrate the third plate body, the second interval spaces are located between the corresponding sub negative pressure regions and the main negative pressure region, and communicative to the main negative pressure region and selectively communicative to the sub negative pressure regions, and the third plate body is further connected to the cavity.

4. The cardboard conveyor device of claim 3, wherein the plate body structure is divided to have a main operation region, wherein the first plate body within the main operation region is fixed.

5. The cardboard conveyor device of claim 4, wherein the plate body structure is further divided to have two extension operation regions respectively on two sides of the main operation region, wherein one end of the plate body controller is connected to the first plate body, the plate body controller controls the first plate body within the two extension operation regions to displace, thus making the two air holes of the first plate body within the two extension operation regions not communicative to the first interval spaces and the second interval spaces, and prohibiting the sub negative pressure regions to be formed within the extension operation regions.

6. A cardboard conveying method, comprising:

providing a cardboard conveyor device, wherein the cardboard conveyor device comprises at least an aspirator, a conveyor belt having holes on a surface of the conveyor belt, at least a plate body structure having wind shield structures, conveying rollers, at least a frame body and a cavity having an interior communicative to the aspirator, when the aspirator is activated to evacuate, the interior of the cavity forms a main negative pressure region, the plate body structure forms sub negative pressure regions, and the sub negative pressure regions are communicative to the main negative pressure region, thus providing a negative pressure to at least a cardboard on the conveyor belt facing to a conveying side; and activating the aspirator and a motor connected to the conveying rollers, so as to drive the conveying rollers to rotate, and to drive the conveyor belt to convey the cardboard on the conveyor belt facing to the conveying side, such that the main negative pressure region provides the negative pressure the cardboard on the conveyor belt facing to the conveying side via the sub negative pressure regions, wherein the cardboard conveyor device further comprises:

at least a plate body controller, configured to control at least a portion of the wind shield structures to displace, so as to make the portion of the plate body structures do not form the sub negative pressure regions.

7. The cardboard conveying method of claim 6, wherein the plate body structure further comprises a first plate body, the first plate body has two air holes which penetrate the first plate body, so as to form the wind shield structures, and the two air holes are respectively on at least two sides of each of the wind shield structures, wherein the two air holes are configured to make the sub negative pressure regions communicative to the main negative pressure region.

8. The cardboard conveying method of claim 7, wherein the plate body structure further comprises a second plate body and a third plate body, the first plate body is disposed between the second plate body and the third plate body, the second plate body is formed to have first interval spaces which penetrate the second plate body, the sub negative pressure regions are formed while the first interval spaces are communicative to the main negative pressure region, each of the first interval spaces is communicative to the corresponding two air holes, the third plate body is formed to have second interval spaces which penetrate the third plate body, the second interval spaces are located between the corresponding sub negative pressure regions and the main negative pressure region, and communicative to the main negative pressure region, and the third plate body is further connected to the cavity.

9. The cardboard conveying method of claim 8, wherein the plate body structure is divided to have a main operation region, wherein the first plate body within the main operation region is fixed.

10. The cardboard conveying method of claim 9, wherein the plate body structure is further divided to have two extension operation regions respectively on two sides of the main operation region, wherein one end of the plate body controller is connected to the first plate body, the plate body controller controls the first plate body within the two extension operation regions to displace, thus making the two air holes of the first plate body within the two extension operation regions not communicative to the first interval spaces and the second interval spaces, and prohibiting the sub negative pressure regions to be formed within the extension operation regions.

11. The cardboard conveying method of claim 10, further comprising:

using the plate body controller to control the first plate body within the extension operation regions to displace, such that the two air holes of the first plate body within the extension operation regions are masked and not communicative to the main negative pressure region and the sub negative pressure regions.

12. A plate body structure used in a cardboard conveyor device, comprising:

a first plate body, wherein the first plate body has two air holes which penetrate the first plate body, so as to form wind shield structures, and the two air holes are respectively on at least two sides of each of the wind shield structures, wherein the two air holes are configured to make sub negative pressure regions of a cardboard conveyor device communicative to the main negative pressure region of the cardboard conveyor device;

a second plate body, wherein the second plate body is formed to have first interval spaces which penetrate the second plate body; and a third plate body, wherein the third plate body is formed to have second interval spaces which penetrate the third plate body;

wherein the first plate body is disposed between the second plate body and the third plate body, each of the first interval spaces is communicative to the corresponding two air holes, the sub negative pressure regions are formed while the first interval spaces are communicative to a main negative pressure region, and the second interval spaces are located between the corresponding sub negative pressure regions and the main negative pressure region, and communicative to the main negative pressure region and selectively communicative to the sub negative pressure regions, wherein the plate body structure is divided to have a main operation region, wherein the first plate body within the main operation region is fixed, and wherein the plate body structure is further divided to have two extension operation regions respectively on two sides of the main operation region, and the first plate body within the two extension operation regions is controlled by at least a plate body controller of a cardboard conveyor device to displace, thus prohibiting the sub negative pressure regions to be formed within the extension operation regions.

* * * * *